United States Patent [19]

Takebe et al.

[11] 4,212,154

[45] Jul. 15, 1980

[54] TIME STRIKING DEVICE FOR ELECTRONIC TIMEPIECE

[75] Inventors: Katsuhiko Takebe, Machida; Masao Fukuda, Kurihashi; Minoru Shiratori; Minosaku Aso, both of Showa, all of Japan

[73] Assignee: Rhythm Watch Company Limited, Tokyo, Japan

[21] Appl. No.: 30,733

[22] Filed: Apr. 17, 1979

[30] Foreign Application Priority Data

Apr. 27, 1978 [JP] Japan ..... 53-50406

[51] Int. Cl.[2] ..... G04B 21/02; G04C 21/06

[52] U.S. Cl. ..... 368/248; 368/72

[58] Field of Search ..... 58/9, 12, 13, 38 R, 58/38 A, 57.5, 152; 340/384 E

[56] References Cited

U.S. PATENT DOCUMENTS 4,148,181 4/1979 Scheer ..... 58/13

*Primary Examiner*—Edith S. Jackmon

*Attorney, Agent, or Firm*—Koda and Androlia

[57] ABSTRACT

A time striking device for an electronic timepiece including a time striking signal detecting means coordinately arranged and installed in a time indicating gear train of an electronic timepiece and supplying a time striking signal prior to a striking time at every striking time, a reference zero second detecting means counting timepiece driving pulses and supplying a reference zero second signal, a coincidence circuit supplying a primary time striking direction signal by the coincidence of the outputs from these two detecting means, a frequency dividing circuit counting the timepiece driving pulses and sending out the secondary time striking direction signal at a desired time interval, a selecting circuit selectively supplying the primary time striking direction from the coincidence circuit and the secondary time striking direction signal from the frequency dividing circuit to a time striking section.

6 Claims, 6 Drawing Figures

TIME STRIKING DEVICE FOR ELECTRONIC TIMEPIECE

BACKGROUND OF THE INVENTION

1. Field of the Invention

This invention relates to a time striking device for an electronic timepiece and more particularly, to a time striking device for an electronic timepiece performing time striking action with high accuracy.

2. Description of Prior Art

A time striking device is well known in the art as a means for time striking or chiming at an indicated time at such right time as 0 minutes, 15 minutes, 30 minutes or 45 minutes, etc. In order to perform the time striking action the prior art device has a cam contact mechanism installed in a time indicating gear train of an timepiece, and the time striking action is obtained when the cam contacts are put in an on-status at a previously requested time. Therefore, the accuracy of the conventional time striking device depends on the one of mechanical cam member, and the prior art device leads to a time striking error of more than one minute in ordinary circumstances. The prior art device has a drawback in recent years that the benefit of an accurate timepiece using a crystal oscillator is extremely reduced due to the existance of this time striking error.

SUMMARY OF THE INVENTION

Accordingly, it is a general object of the present invention to provide a time striking device for an electronic timepiece capable of controlling striking time with high accuracy.

In keeping with the principles of the present invention, the object is accomplished by a time striking device including a time striking signal detecting means installed in a time indicating gear train of a timepiece sending out the time striking signal at every indicated time desired, and a reference zero second detecting means counting clock driving pulses and sending out a reference zero second signal. The coincidence of the outputs from these two detecting means provides the primary time striking direction signal as well as counts the clock driving pulses and provides the secondary time striking direction signal at a desired time interval. Consequently, the time striking action can be obtained with high accuracy since the striking time is determined by the reference zero second signal synchronized to the clock driving pulses.

In the present invention the time striking signal detecting means can be made up with the cam contact mechanism as mentioned in the prior art, and the time striking signal can be obtained once an hour or once every fifteen minutes in accordance with the time striking action. The time striking signal is provided by the time striking signal detecting means earlier than the fixed striking time as the on-operation time of the cam contacts, and selected one minute earlier than the indicating time under the ordinary circumstances. It is comparatively easy to obtain the time striking signal detecting accuracy by the use of the cam mechanism installed on a minute wheel in a time indicating gear train of a timepiece, but it is hard to keep all the signal accuracy within the before-mentioned range when the time striking signal is obtained at a fifteen minute interval. Such being the case, the present invention enables to control the right time signal of short time striking interval with high accuracy by utilizing a frequency dividing circuit counting the clock driving pulses and a secondary time striking signal provided from the frequency dividing circuit. In another words, when many right time signals are needed within one hour, a signal from the accurately controlled time striking signal detector of the time striking signal detecting means triggers the initial time of the before-mentioned frequency dividing circuit, and afterwards only this frequency dividing circuit regulates and controls the striking time per se. Consequently, the time striking signal detecting means with comparatively low accuracy performs a complimentary time striking control action in an initial period of transition until the striking time is controlled by the frequency dividing circuit. In this case, the time striking signal provided from the time striking signal detecting means with comparatively high accuracy can be used together with the time striking signal provided from the frequency dividing circuit, or the time striking signal provided from the frequency dividing circuit can only be used. In the present invention there is a selecting circuit equipped in order to select the desired time striking signal in every plural kinds of period including the above-mentioned initial period of transition and the established ordinary time striking period.

In an electronic timepiece a crystal oscillator and the other signal source with high accuracy are used for standard time signal generators, and the time striking signal timing is directly obtained from this signal source for reference zero seconds, but there exists an error between the signal source and the indicated time in the time display means as a result of time correction. In the present invention a reset signal is supplied to the above-mentioned reference zero second detecting means when the time correction performs the zero second resetting operation, and the zero second reset takes effect in the zero second returning. Thus, the reference zero second signal is provided in accordance with the newly established indicating time.

In the present invention the reference zero second can be established at any second, 10 seconds for example, as well as 0 seconds are indicated.

BRIEF DESCRIPTION OF THE INVENTION

The above mentioned and other features and object of the present invention will become more apparent by reference to the following description taken in conjunction with the accompanying drawings, wherein like reference numerals denote like elements, and in which.

DETAILED DESCRIPTION OF THE INVENTION

Figure 1:
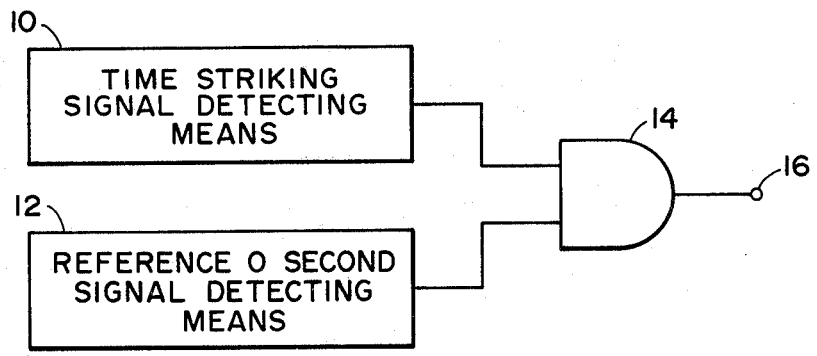
FIG. 1 is a schematic illustration of constitution showing a principle of a time striking device in an electronic timepiece in accordance with the teachings of the present invention.

Referring more particularly to the drawings, showing in FIG. 1 is basic principle constitution of the present invention. A time striking signal sent from a time striking signal detecting means 10 and a reference zero second signal supplied from a reference zero second signal detecting means 12 are verified at a coincidence circuit 14 and a time striking direction signal is sent out to an output terminal 16 of this circuit. Therefore, the time striking signal is corrected by the output signal from the reference zero second detecting means 12, and is obtained at reference zero second even when the time striking signal of the output from the time striking signal detecting means 10 is not coincided with the reference zero second.

Figure 2:
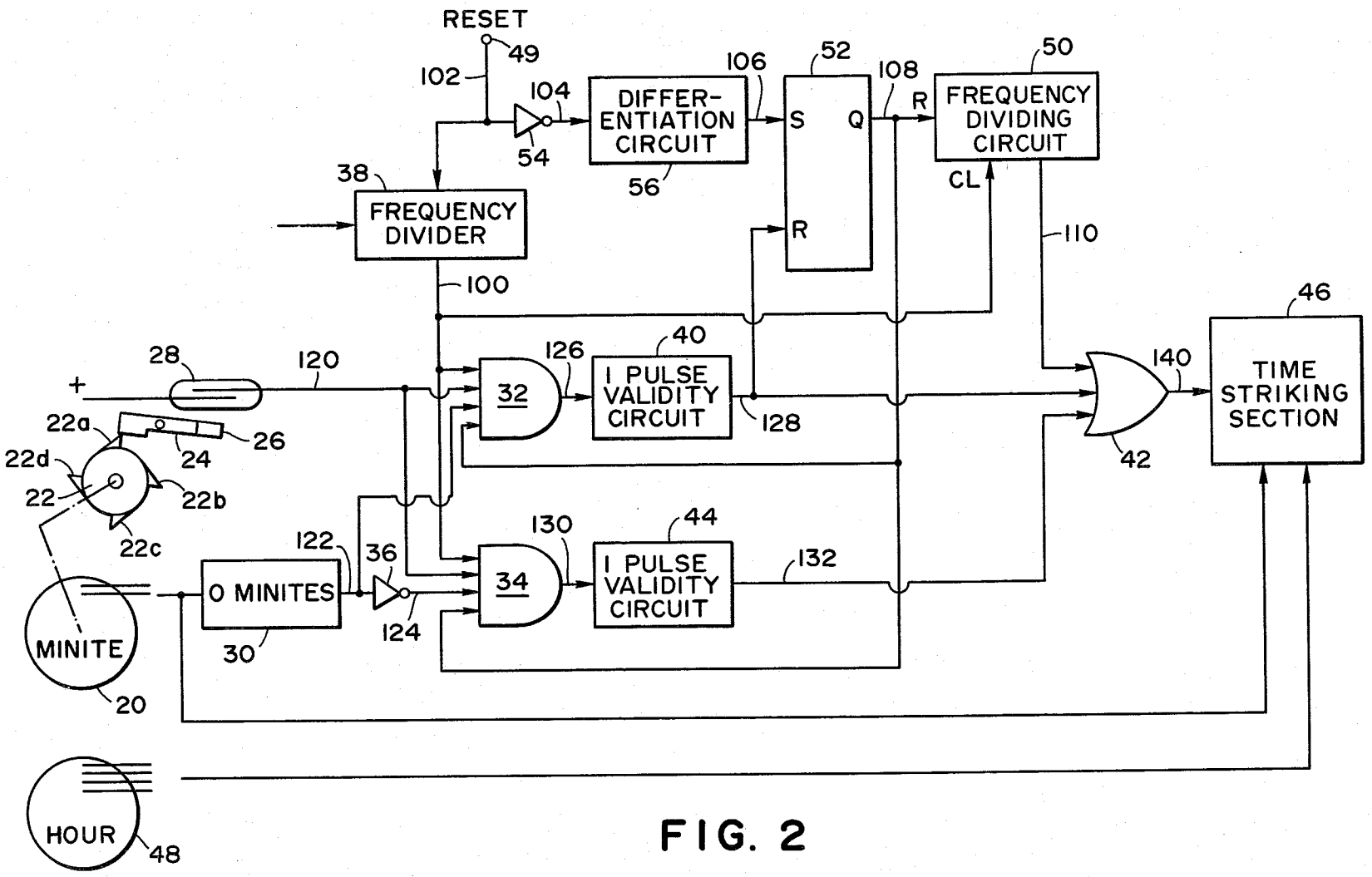
FIG. 2 is a block diagram illustrating a first preferred embodiment of the time striking device in accordance with the teachings of the present invention.

Referring to FIG. 2, shown therein is a first preferred embodiment of the time striking device in accordance with the teachings of the present invention. The time striking signal detecting means 10 includes a minute hand wheel 20 in a time indicating gear train of a timepiece and a cam member 22 fixed to the minute hand wheel 20. There is installed a binary 2 bit contact point pattern on the circumference of the minute hand wheel 20, and the time striking signal is obtained from a sliding contact point connecting to the minute hand wheel 20, corresponding to the contact point pattern on the circumference of the minute hand wheel 20. The cam member 22 has four cam projections of *22a, 22b, 22c* and *22d* on the circumference thereof, and each of the cam projections swings a swinging lever 24. On the end of the swinging lever 24 a permanent magnet 24 is attached, and the movement of this permanent magnet controls on and off action of a lead switch 28. According to the embodiment shown in FIG. 2, the time striking signal can be obtained from the minute hand wheel 20 and the cam member 22 corresponding to a right time signal at a fifteen minutes interval, that is, predetermined time of 0 minutes, 15 minutes, 30 minutes and 45 minutes. The time striking signal at the lead switch 28 is directly supplied to a coincidence circuit, and the time striking signal detected through the contact point pattern of the minute hand wheel 20 is sent to the coincidence circuit via a 0 minute detecting circuit 30. The 0 minute detecting circuit reads the output signal from the minute hand wheel 20, and supplies the signal to the coincidence circuit when it receives the signal pattern corresponding to the right time of 0 minutes.

The coincidence circuit in the first embodiment consists in a first coincidence circuit 32 and a second coincidence circuit 34 which are composed of AND gate. The output of the lead switch 28 is supplied to both coincidence circuits 32 and 34, and the output from the zero minute detecting circuit 30 is directly supplied to the first coincidence circuit 32 and is supplied to the second coincidence circuit 34 by way of an inverter 36.

The reference zero second detecting means 12 in the first embodiment is formed up with a frequency divider 38 and sends out the reference zero second signal to the first and the second coincidence circuits 32 and 34 at 0 seconds in every one minute, counting the timepiece driving pulses.

The afore-mentioned first coincidence circuit 32 performs a logic operation on the time striking signal at the right time of 0 minutes and the reference zero second signal, and sends out the signal at the right time of 0 minutes at reference zero seconds to an OR gate 42 by way of a one pulse validity circuit 40. In the same manner, the second coincidence circuit 34 synchronizes the right time signal of 15 minutes, 30 minutes and 45 minutes with the reference zero second signal by the time striking signal obtained from the lead switch 28 and the signal obtained from the 0 minute detecting circuit 30 by way of the inverter 36, and supplies the time striking signal of reference zero second at each right time through a one pulse validity circuit 40 to an OR gate 42.

The OR gate 42 supplies the input signals to a time striking section 46, which performs a time striking action such as striking and chiming, etc. in accordance with the time striking direction sent from the contact point pattern of the minute hand wheel 20 and the time striking direction provided from an hour hand wheel 48. The hour hand wheel 48 is known to have a binary 4 bit contact point pattern on the circumference thereof and to send the time striking direction to the time striking section corresponding to each right time.

The basic composition of the first embodiment is revealed in the above description, but there are various supplemental devices included in the first embodiment.

The frequency divider 38 synchronizes a signal source of crystal oscillator, etc., but there happens the case an indicated time in the display means does not coincide with the reference zero second signal in correcting time. In order to avoid this the first embodiment has such composition that the supply of a reset signal from a terminal 49 to the frequency divider 38 in zero second resetting operation performs zero second reset at the time of zero second reset, and that the reference zero second signal of the frequency divider 38 and the indicated time are always coincided.

In the first embodiment equipped is a means generating secondary time striking signal obtained from counts of timepiece driving pulses, which is separate from the primary time striking signal obtained from the coincidence circuit, and, furthermore, equipped is a selecting circuit to provide both time striking signals to the time striking section selectively.

The secondary time striking signal generator is composed by a frequency dividing circuit 50 and the input clock pulse is consisted of one minute interval pulse from the afore-mentioned frequency divider 38. In the illustrated embodiment the frequency dividing circuit 50 supplies the pulse to the OR gate 42 at a 15 minute interval and provides the time striking signal at 0 minutes, 15 minutes, 30 minutes and 45 minutes.

The selecting circuit is consisted of a flip-flop 52, which selects the primary time striking signal from the coincidence circuits 32 and 34 and the secondary time striking signal from the frequency dividing circuit 50. In the illustrated embodiment the primary time striking signal from the coincidence circuits 32 and 34 is utilized in the initial period of transition from the moment to start a time indication or to correct the time indication till the right time of 0 minutes, and the secondary time striking signal of the frequency dividing circuit 50 is utilized afterwards. The reset signal provided to the terminal 49 in zero second resetting operation is supplied to the setting terminal of the flip-flop 52 through an inverter 54 and a diferentiation circuit 56. The output of the one pulse validity circuit 40 is supplied to a reset terminal of the flip-flop 52 and the output Q terminal is connected to a reset terminal of the frequency dividing circuit 50. The output Q terminal of the flip-flop 52 is also connected to the input terminals of the primary and the secondary coincidence circuits 32 and 34.

Figure 4:
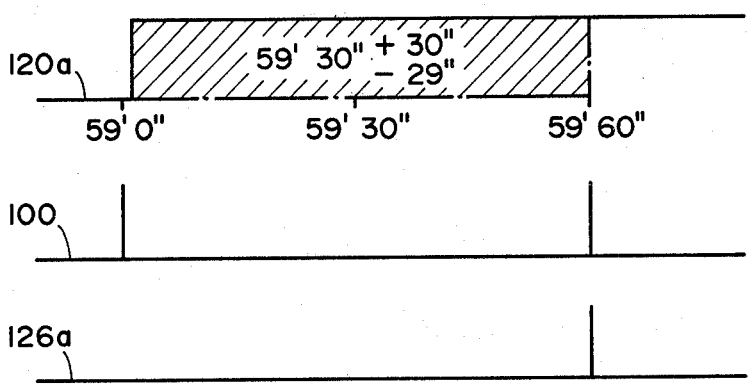
FIG. 4 is a wave form chart showing a time striking signal detecting action at a right time of 0 minutes in FIG. 2.
Figure 5:
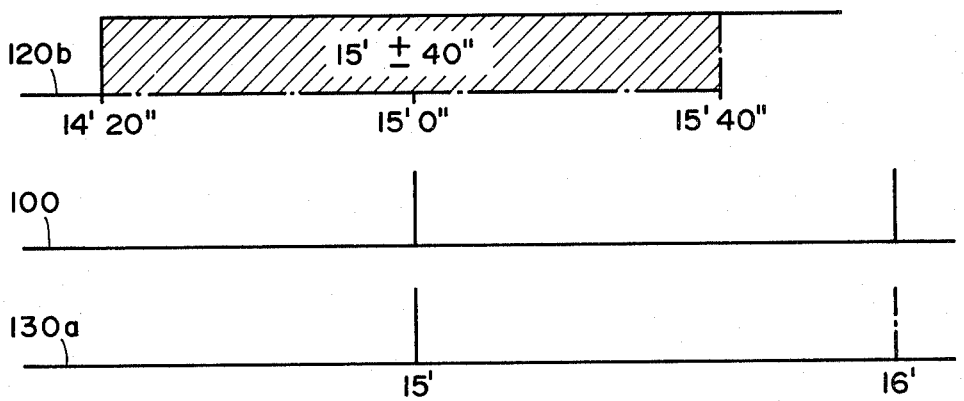
FIG. 5 is a wave form chart showing a time striking signal detecting action at a right time of 15 minutes.

The first embodiment of the present invention is composed as described in the above and detailed operation is described in the following by references to the wave form charts shown in FIGS. 3, 4 and 5.

The output 100 of the frequency divider 38 is synchronized with the timepiece driving pulse and composes the output pulse in one minute interval. The output pulse 100, however, cannot always be synchronized with the hand position in the display means of clock, especially in a moment to start a time indication or to correct the time indication. In the embodiment a reset signal 102 is supplied from the terminal 49 in the zero second resetting operation performed in time correction or clock start and the output of the frequency divider 38 is controlled and synchronized when the reset pulse 102 falls down. The reset pulse 102 is inverted by the inverter 54 (signal 104), and changed into a setting signal 106 by way of the differentiation circuit 56 to set the flip-flop 52. Therefore, from the output Q terminal of the flip-flop 52 the "1" signal 108 is supplied to the reset terminal of the frequency dividing terminal 50, and to the inputs of the coincidence circuits 32 and 34. Consequently, the counting operation of the frequency dividing circuit 50 is restrained, but the gate opening signal is provided to the coincidence circuits 32 and 34 on the other hand.

With the rotating of the minute hand wheel 20 the cam member 22 controls on and off the lead switch 28 and four right time signals 120 per an hour are sent out from the lead switch 28.

In the same manner, from the contact point pattern of the minute wheel 20 the signal 122 corresponding to the right time of zero minutes is supplied to the primary coincidence circuit 32 by way of the zero minute detecting circuit 30 and the signal 124 is supplied to the secondary coincidence circuit 34 by way of the inverter 36. Both signals of 120 and 122 produce the output signals for comparatively long time depending on the contacting time of the contact point, for example five to ten minutes.

Each of the coincidence circuits 32 and 34 supplies the outputs 126 and 130 to one pulse validity circuits 40 and 44 respectively in accordance with the above mentioned inputs. Therefore, each of the outputs 126 and 130 consists in the numbers of the reference zero second signal determined by the on-time of the contact point of the time striking signal detector. In the illustrated embodiment it sends out five time striking signals. The one pulse validity circuits 40 and 44 are composed of down counters having a preset value "1" and supply the first received signal to the OR gate 42 for the output pulses 128 and 132.

The output 128 from the one pulse validity circuit 40 is also supplied to the reset terminal of the flip-flop 52 so that the Q terminal of the flip-flop 52 counts "0". At this time the frequency dividing circuit 50 starts the counting action and the secondary time striking signal 110 is supplied to the OR gate 42 at a fifteen minute interval. The output signal 108 from the flip-flop 52 is supplied to the inputs of both coincidence circuits 32 and 34 as "0" signal and controls both coincidence circuits 32 and 34 in the off-state.

The OR gate 42 provides the above mentioned various time striking signals to the time striking section 46 as a time striking direction signal 140, which preforms the time striking action.

In the first embodiment the right time of 0 minutes and the other right times are separated each other and the primary coincidence circuit 32 and the secondary coincidence circuit 34 proceed them respectively. Due to mechanical problem the signal from the cam projection of **22*a* corresponding to the right time of 0 minutes uses the synchronized to the frequency dividing circuit 50 since it is hard to manufacture all the cam projections of 22*a*, 22*b*, 22*c*, and 22*d* with same form. The cam projection 22*a*of cam member 22 corresponds to the right time of 0 minutes and the operating time is set in the range from 59 minutes 30 seconds plus 30 seconds to minus 29 seconds every hour. In FIG. 4 shown therein is an enlarged view of the coincidence action. The signal 120*a* of the lead switch 120 corresponding to the right time of 0 minutes becomes the rising signal within the range from 59 minutes 1 second to 60 minutes 0 seconds and only the pulse at the right time of 0 minutes is sent out from the coincidence circuit 32 accordingly. The decision of error range of the lead switch 28 prior to the right time of 0 minutes and less than one minute can certainly restrain the output 126*a*** from producing the signal at 59 minutes 0 seconds.

On the contrary the other cam projections of **22*b*, 22*c* and 22*d* of the cam member 22 have lower accuracy than the cam projection 22*a* due to accumulated errors. In the ordinary circumstances there is the error range of 40 seconds before and after the determined operation time. In the illustrated embodiment the projections are determined an error range of 40 seconds before and after the right time of every 15 minutes, 30 minutes, and 45 minutes as illustrated in the FIG. 5. Therefore, the signal corresponding to 16 minutes is obtained from the coincidence circuit 34 as shown by the chain line and there exists one minute error against the right time, when the on-operation of the lead switch 28 resulted from the falling of cam member is performed after 15 minutes as shown in the example of right time of 15 minutes in FIG. 5**.

Figure 3:
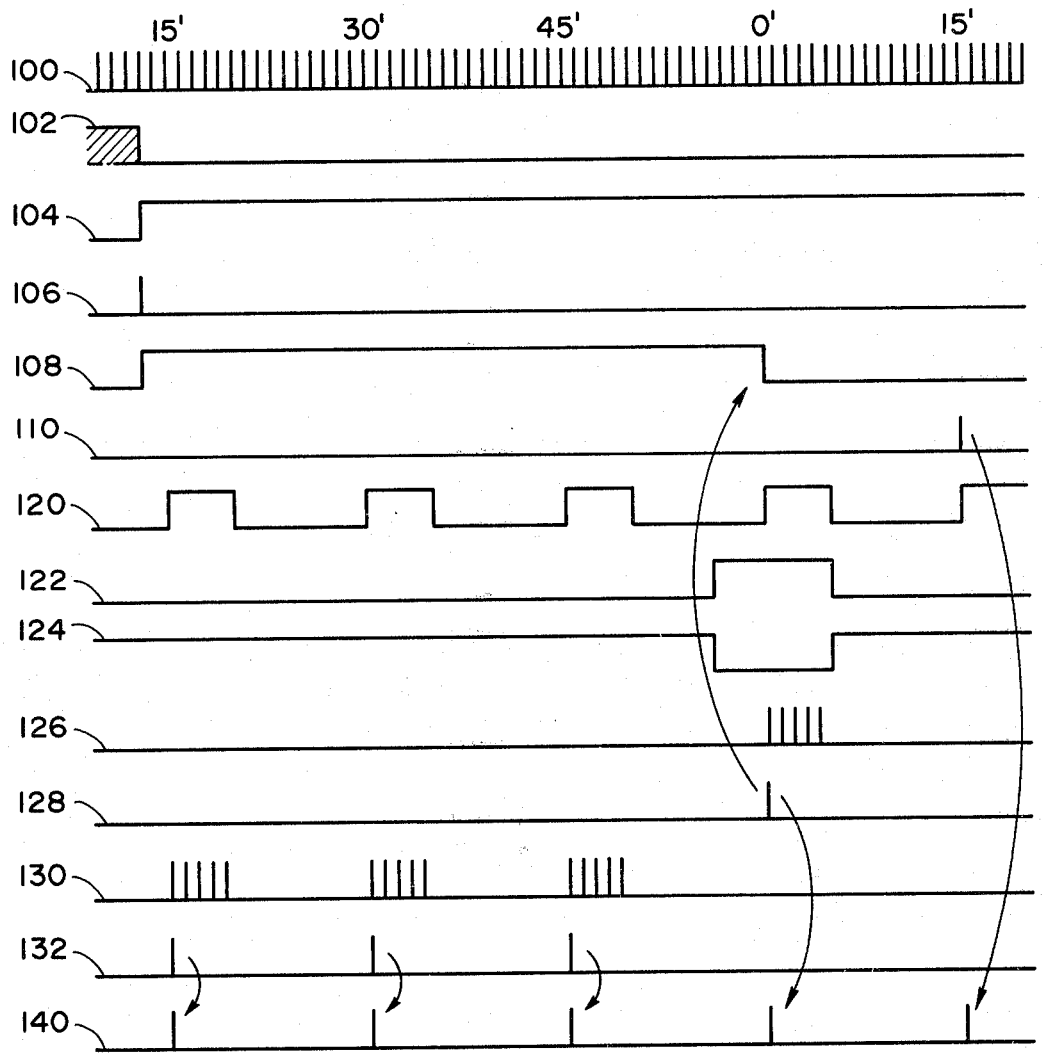
FIG. 3 is a wave form chart of each section shown in FIG. 2.

As described in the wave form chart of FIG. 3, when it is assumed that the zero second resetting operation is performed at the indicating time of 13 minutes, the time striking action at the following right time of 15 minutes, 30 minutes and 45 minutes is done by the signal from the secondary coincidence circuit 34 and there is a possibility of one minute error on time striking accuracy. When the time indicated becomes 0 minutes, the counting action of the frequency dividing circuit 50 is started as well as the right time zero minute time striking signal is obtained from the primary coincidence circuit 32, and the time striking action is controlled by the time striking signal sent from the frequency dividing circuit from the following right time of 15 minutes and afterwards.

As described in the above, according to the first embodiment, the time striking action is performed by the primary time striking signal supplied from the coincidence circuit in the initial period of transition till the right time of 0 minutes, and the secondary time striking signal from the frequency dividing circuit after the right time of 0 minutes. In the first embodiment supply of the output from the flip-flop 52 to the primary coincidence circuit 32 controls the output of the coincidence circuit 32 after terminating the initial period of transition. However, the same kind of action can be obtained without supplying the output of the flip-flop 52 to the primary coincidence circuit 32 since the signal 128 supplied from the primary coincidence circuit 32 by way of the one pulse validity circuit 40 coincides with the signal from the frequency dividing circuit 50.

Figure 6:
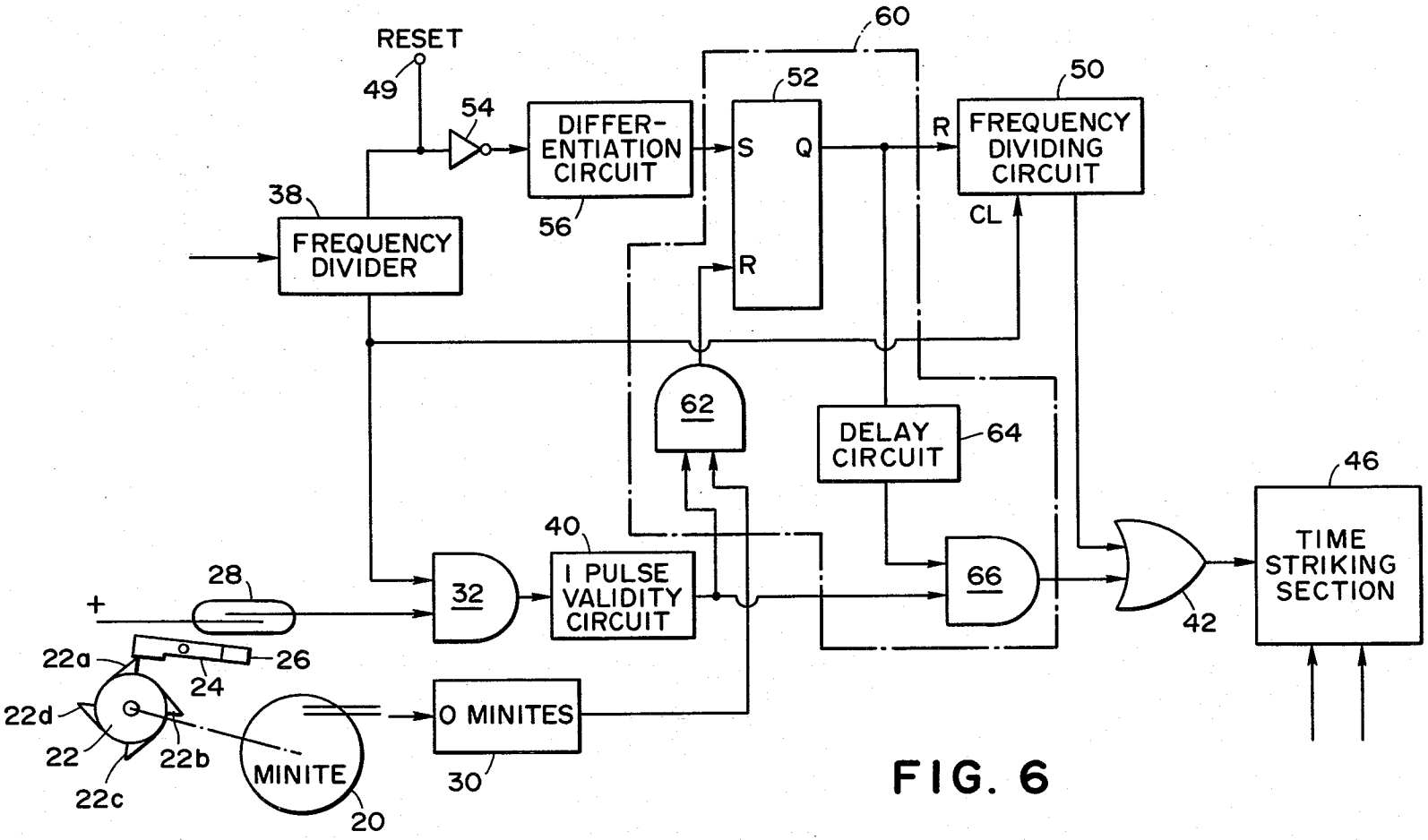
FIG. 6 is a block diagram illustrating a second preferred embodiment of the time striking device in accordance with the teachings of the present invention.

Referring to FIG. 6, shown therein is a second preferred embodiment of the time striking device in accordance with the teachings of the present invention. Since the second embodiment is similar to the first embodiment, like elements are given like reference numerals and a description of their interconnection and operation is omitted.

In the second embodiment there is a selecting circuit 60, which is defferent from the first embodiment, and the coincidence circuit is composed of only the primary coincidence circuit 32 which is directly connected to the lead switch 28. The selecting circuit includes an AND gate 62 supplying the output thereof to the reset terminal R of the flip-flop 52 and an AND gate 66 supplied the input signal from the output Q terminal of the flip-flop 52 by way of a delay circuit 64. The right time 0 minute time striking signal is supplied to the input terminal of the AND gate 62 by way of the output terminal of the one pulse validity circuit 40 and the 0 minute detecting circuit 30 from the minute hand wheel 20, and the output Q terminal of the flip-flop 52 is changed and controlled from "1" to "0". The output at the Q terminal is supplied to the AND gate 66 with some delay by way of the delay circuit 64 together with the output of the one pulse validity circuit 40, and the AND gate 66 is closed after the right time of 0 minutes.

As mentioned in the above, in the second embodiment the selecting circuit 60 can also select the time striking signal in the initial period of transition and afterwards.

As described hereinabove, the present invention provides an effective time striking signal obtained from the verification between the reference zero signal and the time striking signal sent from the cam contact points. Thus, the present invention has the advantages of obtaining the time striking action with high accuracy and the correct synchronizing action without disordering the synchronization between the reference zero seconds and the indicated time at the zero second resetting.

In all cases it is understood that the above described embodiments are merely illustrative of but a few of the many possible specific embodiments which represent the applications of the principles of the present invention. Numerous and varied other arrangements can be readily devised by those skilled in the art without departing from the spirit and scope of the invention.

I claim:

1. A time striking device of an electronic timepiece having a time indicating gear train driven by timepiece driving pulses, comprising a time striking signal detecting means coordinately arranged and installed in the time indicating gear train and supplying the time striking signal prior to striking time at every striking time, a reference zero second detecting means counting the timepiece driving pulses and supplying a reference zero second signal, a coincidence circuit supplying a primary time striking direction signal by the coincidence of the outputs from said two detecting means, a frequency dividing circuit for counting said timepiece driving pulses and for sending out a secondary time striking direction signal at a desired time interval, a selecting circuit selectively supplying said primary time striking direction signal from said coincidence circuit and said secondary time striking direction signal from said frequency dividing circuit to a time striking section.

2. A time striking device according to claim 1 wherein said reference zero second detecting means is supplied a reset signal by a reset switch capable of being externally operated.

3. A time striking device according to claim 1 wherein said reference zero second detecting means is supplied a reset signal in a zero second resetting operation and performs an electrical zero second reset at a time of mechanical zero second reset.

4. A time striking device according to claim 1 wherein said time striking signal detecting means comprises more than two detectors coordinately arranged and installed in the time indicating gear train of the timepiece in order to detect more than two time striking signals per hour, said coincidence circuit comprises a primary coincidence circuit corresponding to one detector of said time striking signal detecting means and a secondary coincidence circuit corresponding to the other detector, the output of said primary coincidence circuit starts counting said timepiece driving pulses of said frequency driving circuit.

5. A time striking device according to claim 1 wherein said time striking signal detecting means comprises more than two detectors coordinately arranged and installed in the time indicating gear train of the timepiece in order to detect more than two time striking signals per hour, said coincidence circuit comprises said primary coincidence circuit corresponding to one detector of said time striking signal detecting means, said frequency dividing circuit continues counting said timepiece driving pulses with no relation to the second and the following outputs of said primary coincidence circuit after the output of said primary coincidence circuit occurs to start counting said timepiece driving pulses of said frequency dividing circuit.

6. A time striking device according to claim 1 wherein said time striking signal detecting means comprises more than two detectors coordinately arranged and installed in the time indicating gear train of the timepiece in order to detect more than two time striking signals per hour, said coincidence circuit comprises said primary coincidence circuit corresponding to one detector of said time striking signal detecting means, the next output from said primary coincidence circuit, after the output from said primary coincidence circuit starts counting said timepiece driving pulses of said frequency dividing circuit, performs reset action, everytime of which re-starts counting said timepiece driving pulses.

* * * * *